US005353710A

United States Patent [19]

Eches et al.

[11] Patent Number: 5,353,710

[45] Date of Patent: Oct. 11, 1994

[54] CONTAINER FITTED WITH ELECTRICAL CONNECTING MEANS

[75] Inventors: Nicolas Eches; Bernard Brion, both of Bourges; Michel Brule, Lury; Rene Laurensou, Bourges, all of France

[73] Assignee: Giat Industries, France

[21] Appl. No.: 957,550

[22] Filed: Oct. 8, 1992

Related U.S. Application Data

[63] Continuation-in-part of Ser. No. 832,304, Feb. 7, 1992, Pat. No. 5,241,909.

[30] Foreign Application Priority Data

Jan. 22, 1992 [EP] European Pat. Off. ..... 92400170.4

[51] Int. Cl.[5] ..... F42B 5/16

[52] U.S. Cl. ..... 102/443; 102/472; 102/217; 102/202; 102/202.9

[58] Field of Search ..... 102/202.6, 438, 202, 102/202.8, 202.9, 202.5, 202.14, 472, 443, 282, 217

[56] References Cited

U.S. PATENT DOCUMENTS

| | | | |
|---|---|---|---|
| 777,319 | 12/1904 | Ulrich | 102/430 |
| 2,743,580 | 5/1956 | Loeb, Jr. | 102/202 |
| 3,136,872 | 6/1964 | Banaszak | 102/202 |
| 3,299,812 | 1/1967 | Suh et al. | 102/202.5 |
| 3,656,304 | 4/1972 | McCullough | 102/202 |
| 3,759,183 | 9/1973 | Apstein | 102/202.5 |
| 3,952,658 | 4/1976 | Broyles | 102/438 |
| 4,313,379 | 2/1982 | Vallace | 102/217 |
| 4,616,565 | 10/1986 | Reinovsky | 102/202.7 |
| 4,619,202 | 10/1986 | Romev et al. | 102/443 |

FOREIGN PATENT DOCUMENTS

| | | | |
|---|---|---|---|
| 0124183 | 11/1984 | European Pat. Off. . | |
| 0314547 | 5/1989 | European Pat. Off. . | |
| 0552266 | 8/1958 | Italy | 102/472 |
| 0332143 | 10/1958 | Switzerland | 102/443 |
| 500052 | 1/1971 | Switzerland . | |
| 0729372 | 5/1955 | United Kingdom | 102/472 |
| 2136929 | 9/1984 | United Kingdom . | |

*Primary Examiner*—Stephen M. Johnson
*Attorney, Agent, or Firm*—Parkhurst, Wendel & Rossi

[57] ABSTRACT

The technical aspect of the invention relates to containers for a propulsive charge in at least two parts. The container (1*a*–1*b*)) according to the invention comprises a casing (9*a*–9*b*) demarcating an internal space, in which may be positioned, in particular, a propulsive charge, and it is intended to be rigidly affixed to a second container at one of their frontal faces (10*a*–10*b*), wherein it comprises means for the conduction of electricity, intended to receive and transmit a signal emanating from the weapon, as well as connecting means for providing, after the first container has been rigidly affixed to the second container, an electrical connection between these conduction means and other conduction means in the second container. Application for tank ammunition.

47 Claims, 5 Drawing Sheets

CONTAINER FITTED WITH ELECTRICAL CONNECTING MEANS

This application is a continuation-in-part of U.S. application Ser. No. 07/832,304 filed on Feb. 7, 1992, now U.S. Pat. No. 5,241,909.

BACKGROUND OF THE INVENTION

1. Field of the Invention

The scope of the present invention ms containers that can hold a propellant charge and more particularly, containers used for large calibre or tank artillery.

In order to adjust firing range, it is frequently necessary to modify the amount of powder which is used to launch a projectile.

2. Description of the Prior Art

Appreciably cylindrical modular containers made from combustible material have already been designed (see, for example, WO8601584). Because of their rigidity, such containers are easier to use than traditional powder bags.

In order to reduce the amount of space taken up by ammunition inside armoured vehicles, it may also be necessary to divide it up into two separate parts, one carrying the main propulsive charge and the other the projectile and any secondary charge (see for example, British patent GB2136929).

State-of-the-art two-part containers or ammunition are made from combustible materials which are also usually non-conducting materials.

Currently, the fuses carried by projectiles are either programmed outside the weapon or in the feeding chutes and in all situations some time prior to firing.

In order to carry out or modify the programming of a fuse carried by the projectile, or charge a capacitor carried by this, it would be useful to be able to establish an electrical connection between the weapon and the projectile.

However, division of the ammunition into two parts which are usually fully combustible does not allow an electrical connection between the part carrying the projectile and the weapon to be directly and reliably established.

In the particular case in which both containers contain a propulsive charge, the problem of igniting these two charges also arises. In fact, in order to achieve homogeneous ignition and good reproducibility of internal ballistic characteristics, the charge must be ignited more or less immediately along its entire length. Thus, it is traditional practice to use ignition tubes (for example, see French patent FR7606456) for cartridge ammunition. However, such ignition tubes cannot be used with a charge comprising several parts.

WO8601584 proposes a container made from combustible material comprising an axial channel which is bounded by annular compacted ignition materials.

After several of such containers have been stacked, the axial channel has the role of an ignition tube for the whole charge. A single igniter arranged at one end of the channel ensures that there is instantaneous ignition of all of the annular compacted materials.

However, this type of arrangement does have disadvantages. For example, for very long charges (more than 5 calibres long), the igniter is unable to ensure that there is instantaneous ignition of all of the charge. Further, the pressure regime created is not uniform and the ballistic performance is poor and not very reproducible.

SUMMARY OF THE INVENTION

An initial object of the invention is to propose a container intended to be rendered rigid with at least one other container and comprising means permitting a signal to be transmitted between a weapon and a projectile irrespective of the number of containers.

Another object of the invention is to propose an application of these means in achieving instantaneous ignition of all of the propulsive charge, after the containers have been assembled together.

Thus, the object of the invention is a container comprising a case demarcating an internal space, in which, a propulsive charge may be positioned, the container being intended to be rendered rigid with a second container at one of its frontal surfaces. The container comprises means for the conduction of electricity, intended to receive and to transmit a signal emanating from a weapon, as well as the connection means providing, after the first container has been rendered rigid with the second container, an electrical connection between these conduction means and other conduction means on the second container.

It is thus possible to provide easily an electrical connection between the weapon and the projectile, with the information or the energy intended for the projectile being able to be fed to a container near to the weapon's breach.

The conduction means may comprise a conductor that is rigid with the container casing.

Where the container comprises at least one flame transmission device extending axially throughout virtually its entire length, the conduction means may comprise a conductor that is rigid with this flame transmission device.

According to the variants, the conductor may comprise at least one metal strip, a metal film on the internal wall of the container casing, or a metal film on the wall of the flame transmission device.

The electrical connection means may comprise a conducting surface that is rigid with the frontal face.

Where the frontal face is on a cap, the conduction means may comprise a part that is at least equally conducting, of the lateral surface of the cap.

The electrical connection means may also comprise a ring also intended to provide the mechanical connection with the second container.

Where the container according to the invention comprises a bottom container for a two-part propulsive charge and comprising a shell base with an igniter, this bottom container may have a necking intended to be covered over at least partially by the connecting ring and the electrical connection rings may comprise a conductive zone arranged on the part of the necking intended to be covered over by the ring.

When the container according to the invention comprises a projectile-bearing container for a two-part propulsive charge, this projectile-bearing container may have a necking intended to be at least partially covered by the connecting ring and the electrical connection rings may comprise a conductive zone arranged on the part of the necking intended to be covered over by the ring.

In either case, the conductive zone arranged on the necking may comprise at least one conductive U-shaped wire gripped between the casing of the container and a closing cap.

The container according to the invention intended for a propulsive charge made up of at least two parts may comprise an electrical initiation igniter and the conduction and electrical connection means may connect this igniter to a second igniter carried by the second container, with these conduction and connecting means being designed to ensure simultaneous ignition of the two igniters.

The invention will be more clearly understood from the description of particular embodiments, in conjunction with the appended drawings, in which:

DESCRIPTION OF THE PREFERRED EMBODIMENTS

Figure 1:
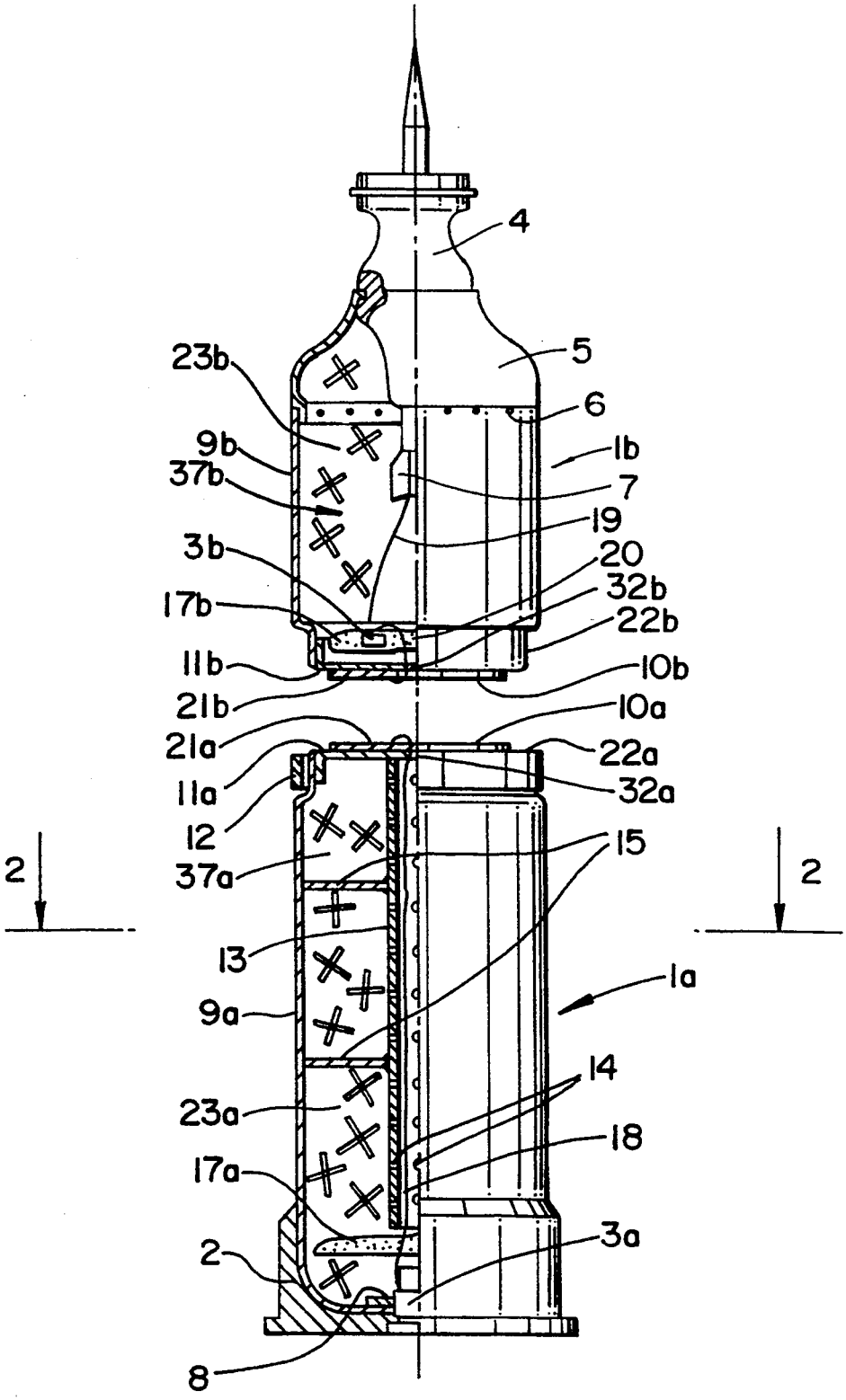
FIG. 1 shows a piece of ammunition, in half section, which is made up of two containers according to the invention that are intended to be joined together.
Figure 6:
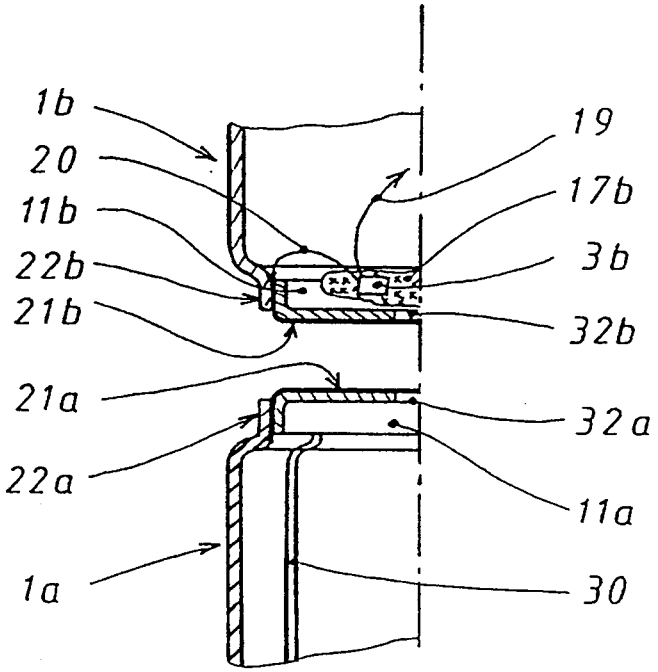
Figure 7:
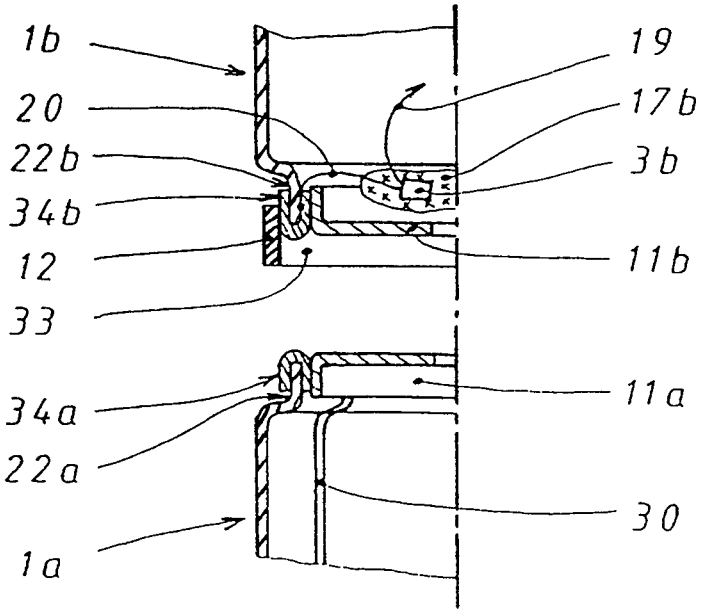
Figure 8:
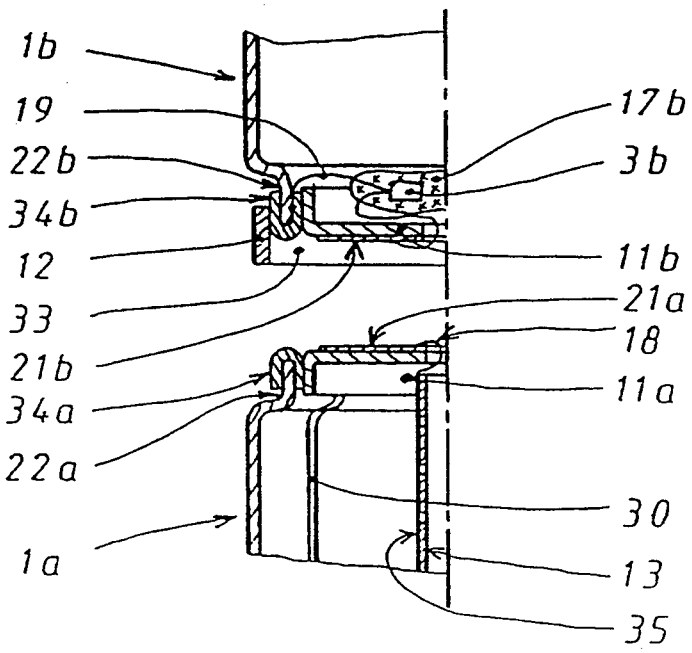

FIGS. 6, 7 and 8 are partial representations of various embodiments of containers according to the invention. Referring to FIG. 1, a piece of ammunition for armoured vehicles includes a charge which comprises two containers, 1*a*, 1*b*.

A bottom container 1*a* has a shell base 2, which is usually made of metal, and an electrical initiation igniter 3*a* that is rigid with the shell base.

The casing 9*a* of this first container is made from a combustible material such as nitrocellulose or cardboard, it is rendered rigid with the shell base 2 using a securing washer 8 (but any other rigid affixing means is possible), and it is sealed off at its other end by a cap 11*a* also made from combustible material.

The casing also has at the end opposite to the shell base a necking 22*a* on which a ring 12 sits whose function will be explained below.

A projectile-bearing container 1*b* also comprises a casing 9*b* made of combustible material. The casing is closed off by a cap 11*b* and it bears a projectile 4 (in this case an arrow-shaped projectile) via a connecting means 5 made from a plastic material, for example, polyamide.

This connecting means 5 is produced by an injection operation on the body of the projectile at an annular groove and it is secured on the casing 9*b* with rivets 6 (adhesive bonding could be used instead of the rivets). The casing 9*b* also comprises a necking 22*b*.

The two containers touch each other at their frontal faces 10*a*, 10*b*. The ring 12 provides proper relative positioning of the two containers and it also enables the two parts of the charge to be rigidly affixed.

To achieve this, it is merely necessary to slide the ring 12 onto the necking 22*b* and to make it overlap the two neckings 22*a* and 22*b*. It is then immobilized in this position using, for example, adhesive paper.

It is also possible to provide a ring 12 whose internal diameter is slightly less than those of the neckings and which provides the connection by means of a localized deformation of the casings 9*a* and 9*b* of the containers.

The container 1*a* demarcates an internal space 37*a* containing a granular propulsive charge 23*a* and a flame transmission device which in this case is a duct 13, made from combustible material, and arranged approximately coaxially with the casing 9*a*. This duct is maintained in position using two combustible spacers 15 which lean against the internal surface of the casing 9*a*.

Figure 2:
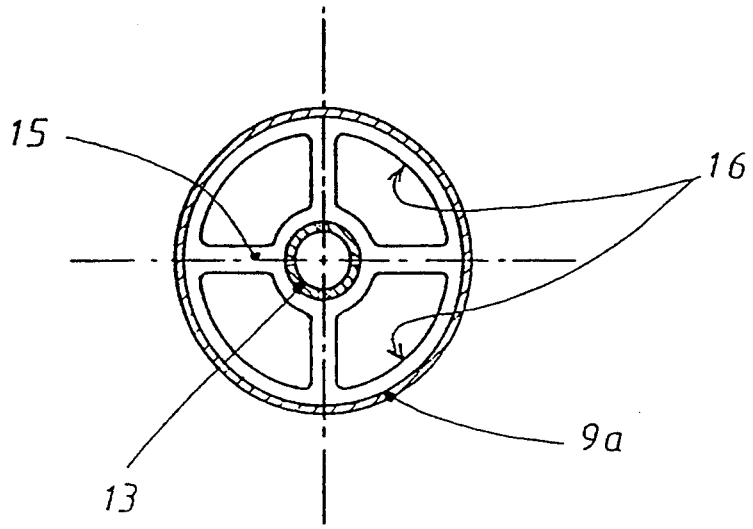
FIG. 2 is a section of FIG. 1 in the plane A—A.

The spacers shall preferably be bonded onto the duct, and contain openings 16 (see FIG. 2) that are regularly spaced out, which facilitate the positioning of the granular propulsive charge 23*a* in the internal space 37*a* of the container.

The duct is pierced with holes 14 for the ignition of the propulsive charge 23*a*. A relay charge 17*a* comprising a bag filled with black powder and covering almost the entire cross section of the container 1*a* is arranged near to the igniter. It ensures ignition of the charge 23*a* on a face that is approximately plane and normal to the axis of the container.

The duct functions as an ignition tube for the part of the charge contained in the bottom container 1*a*. The flame arising from the relay charge 17*a* propagates in the tube and ignites the main charge 23*a* via the holes 14. A wire 18, inside an insulating sheath, provides the electrical connection between the igniter 3*a* and a conductive surface 21*a* arranged on the cap 11*a* at the frontal face 10*a*.

In this particular embodiment, the wire 18 runs along the inside of the duct 13, its stripped end being secured onto the conductive surface using adhesive conductive paper (for example, a self-adhesive aluminium strip).

The container 1*b* demarcates an internal space 37*b* containing a granular propulsive charge 23*b* and a relay charge 17*b* which is a bag of black powder that more or less covers the entire cross section of the container 1*b*.

A second electrical igniter 3*b* of the known type is arranged inside this bag, and is connected by means of an earthing wire 19 to the projectile 4 (in this case via the tail section 7 onto which it is soldered or secured by a self adhesive aluminium strip), and via a connecting wire 20 to a conductive surface 21*b* arranged on the cap 11*b* at the frontal face 10*b*. The stripped end of the wire 20 shall also be affixed using conductive adhesive paper.

The conductive surfaces 21*a* and 21*b* are preferably annular and surround openings 32*a* and 32*b* made in the caps at the axis of the containers.

These openings (closed off using sheets of paper) enable the flame emanating from the igniter 3*a* to be used in order to supplement the ignition of the relay charge 17*b*. It will be advantageous to use the openings 32*a* and 32*b* to let the wires 18 and 20 pass through.

The containers 1*a* and 1*b* therefore comprise within their internal space 37*a*, 37*b* the means for the conduction of electricity (the connecting wire 18 for the container 1*a* and the connecting wires 19 and 20 for the container 1*b*).

These conduction means transmit to the second container 1*b* the firing signal which is supplied by the weapon at the igniter 3*a* that is rigid with the first container 1*a*.

The containers also comprise connection means (conductive surfaces 21*a* and 21*b* of the caps).

These connection means provide the electrical connection between the conductive means of the first container 1*a* and the conductive means of the second container 1*b*.

When the two containers are rigidly affixed to each other, the conductive surfaces 21*a* and 21*b* touch each other, and thus form the electrical connection between the circuits inside the containers 1*a* and 1*b*. The electrical circuit established in this way connects the two igniters 3*a* and 3*b* and provides simultaneous ignition of the two igniters. The propulsive charge 23*b* may be granular but it will advantageously be formed from sticks or strands of powder that have axial orifices. This type of charge provides rapid propagation of the flame front.

The duct could be replaced by another flame transmission device such as a black powder or detonating fuse ignition tube (of the type of those disclosed in patents FR7606456 and FR8113079), in all cases the wire 18 shall be rendered rigid with the device, for example by bonding onto an external generating line of this.

The containers are assembled in the following manner: For container 1*a*, the casing 9*a* is rendered rigid with the shell base carrying the igniter, onto which is attached the wire 18.

Some granular powder is arranged at the bottom of the shell base in order to achieve the maximum filling rate, then the bag of relay charge 17*a* is positioned. The duct 13 with its spacers 15 is arranged in the casing, with the wire 18 running through the inside of the duct.

The case is filled with the propulsive charge 23*a* through the openings 16 of the spacers. The charge is vibrated to achieve the optimum filling rate.

The cap is positioned and the wire 18 connected to the conductive surface 21*a*.

For the container 1*b*, the casing 9*b* is first connected to the projectile using the rivets 6.

The powder is positioned as is the earthing wire 19 and the bag of relay charge 17*b*.

The cap 11*b* is positioned and the wire 20 connected to the conductive surface 21*b*.

Figure 3:
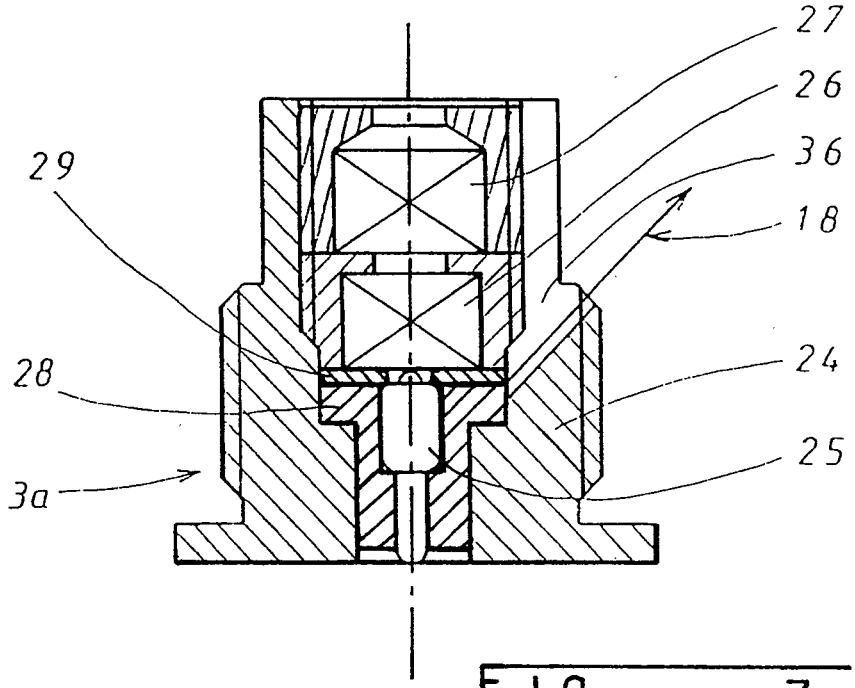
FIG. 3 is a diagrammatic representation of an igniter that has been modified in order to be able to be fitted in a container according to the invention.

FIG. 3 shows the igniter 3*a* which is used. It comprises a conductive body 24 which is screwed into the shell base 2. A casing box holding an igniting primer element 26 is screwed into an axial housing of the body 24.

A second casing box containing a flame reinforcing composition 27 is also screwed into the housing of the body, and is in contact with the casing of the primer element.

A non-conducting support 28 made from plastic material, for example, closes up the axial housing of the body 24 and holds a conductive pin 25 which is in electrical contact via one of its ends with one of the contacts of the primer element 26.

A non-conducting washer 29 is gripped between the non-conducting support 28 and the casing box of the primer element. The connecting wire 18 has one stripped end which is gripped between the non-conducting washer 29 and the pin 25. This wire leaves the body 24 of the igniter through a radial notch 36.

When the assembled containers are being installed in the chamber of a weapon, the primer element 26 is connected to the exposed conductive part of the weapon via the body 24 and the shell base 2.

The igniter 3*b* is connected to the exposed conductive part of the weapon via the projectile 4.

When the instruction to ignite is given, the pin 25 receives a voltage which is transmitted to the primer element 26 and to the igniter 3*b* via the conduction means arranged within the internal spaces of each container and via the connection means which provide the electrical connection between these conduction means after the two containers have been rigidly affixed.

The two igniters are therefore initiated at the same time, which ensures that there is simultaneous ignition of the charges contained within the two containers and that there is a homogeneous pressure state in the chamber of the weapon.

Figure 4:
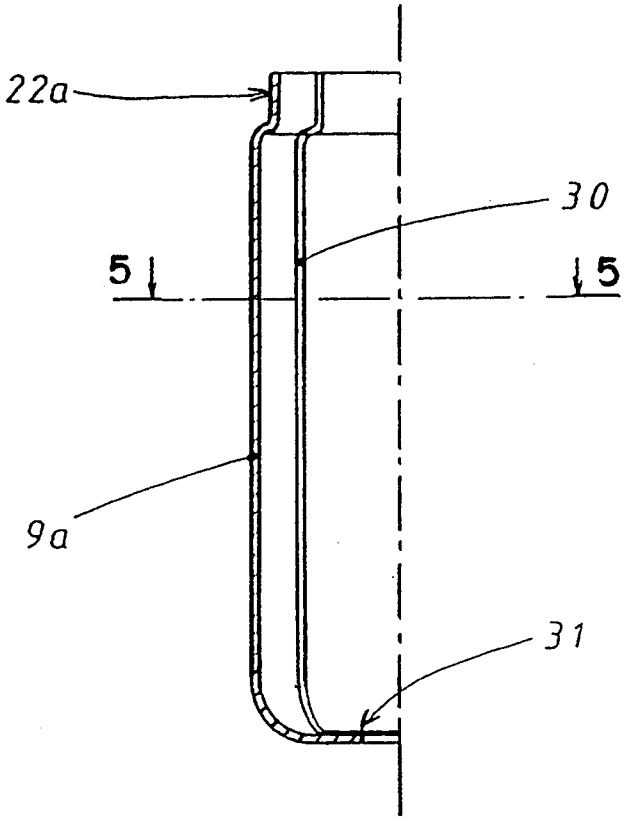
FIGS. 4 and 5 represent only the casing of a container according to a particular embodiment of the invention, FIG. 5 being a half section of FIG. 4 in the plane C—C, and FIG. 4 being a section of FIG. 5 in the plane B—B.
Figure 5:
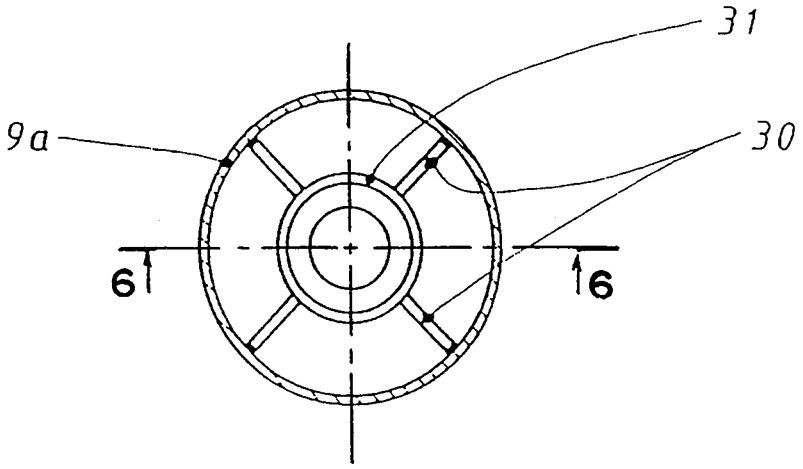

FIGS. 4 and 5 show an embodiment in which the conduction means comprise conductive strips 30 arranged on the internal surface of the casing 9*a* of the container 1*a* and which perform the same function as the connecting wire 18 of the previous embodiment.

These strips, which in this case are four in number and angularly equidistant, are made, for example, by bonding aluminium sheets.

They are electrically connected to each other by a circular strip 31 arranged at the bottom of the casing 9*a* and also made by bonding an aluminium sheet.

A wire (not shown here) connects the igniter 3*a* to the circular strip, for example, using conductive adhesive paper, the diameter of the circular strip 31 will then be greater than the diameter of the securing washer 8 of the casing 9*a* of the shell base 2.

In this case, it may be advantageous to extend the strips 30 on the external surface of the casing at the necking 22*a*.

According to one variant, the conductive strips may be embedded within the thickness of the container casing when this is being made. The ends of the strips shall nevertheless emerge from the casing at the bottom and top ends of the container in order to be able to make the electrical connections with the igniter 3 and with the connection means.

According to another variant, the conduction means could also comprise a metal film over the entire internal surface of the casing 9*a*.

The means for the electrical connection between the strips described like this and the container 1*b* are now going to be defined in detail with reference to FIGS. 6 and 7. In the variant of the embodiment partially shown in FIG. 6, the caps 11*a* and 11*b* have conductive surfaces 21*a* and 21*b* that are approximately annular and intended to be in contact with each other.

These conductive surfaces are extended over at least one part of the lateral surface of the caps so that they come in contact with the strips 30 (for the cap 11*a*), and grip the stripped end of the connecting wire 20 (for the cap 11*b*).

As part of this variant, it would be possible to replace the strips 30 with a connecting wire gripped between the cap 11*a* and the casing 9*a* and connected to the igniter 3*a* as in the configuration of FIG. 1.

It would also be possible to use a container 1*a* whose entire internal surface has had a metal film deposited on it.

In the variant embodiment partially shown in FIG. 7, the caps 11*a* and 11*b* are completely non-conducting. The connection means comprise one or more conductive U-shaped elements 34*a*, 34*b* which are arranged on the neckings 22*a* and 22*b* (for example, folded sheets of aluminium). They are positioned so that they are in electrical contact with the strips 30 (for the U-shaped elements 34*a*), and so that they grip the stripped end of the connecting wire 20 (for at least one of the U-shaped elements 34*b*).

The connection means also comprise the connecting ring 12 which has a conductive internal surface 33 and which therefore provides the electrical connection between the U-shaped elements 34*a* and the U-shaped elements 34*b* after the containers 1*a* and 1*b* have been fitted together.

As part of this variant, it would also be possible to cover part of the internal surface of the cap 11*b*, as well as its periphery that is in contact with the U-shaped elements 34*b*, with a metal film. The connecting wire 20 would then be connected to the metal coated cap via conductive adhesive paper.

Advantageously, the metal film on the inside of the cap could take the form of self-adhesive conductive strips that extend radially from the internal face of the cap 11*b* as far as its peripheral surface in contact with the U-shaped elements.

In certain cases, for example, where the projectile is of the sub-calibre type arranged inside a sabot made from non-conducting material, it may be necessary to connect the earthing wire 19 of the igniter to the exposed conductive part of the weapon via the shell base 2.

FIG. 8 shows a variant of the containers according to the invention which has been adapted for this latter situation.

The container 1*a* has the strips 30 arranged on the internal surface of the casing 9*a* and electrically connected to the shell base 2 (for example by the contact of the circular strips 31 and the securing washer 8), as well as an external metal-coated surface 35 of a duct 13. U-shaped elements 34*a* arranged on the necking 22*a* in the same way as in the previous variant.

An initial connecting wire (not shown here) connects the surface 35 to the igniter 3*a* and a second connecting wire 18 connects this surface 35 to the annular conductive surface 21*a* of the cap 11*a*. The wire 18 will advantageously pass through the axial opening 32*a* of the cap.

The container 1*b* has the U-shaped elements 34*b* which grip the earthing wire 19, with the connecting wire 20 being connected to the annular conductive surface 21*b* through the axial opening 32*b*.

A ring 12 has an internal conductive surface 33 and provides the electrical connection between the U-shaped elements 34*a* and the U-shaped elements 34*b*.

This variant therefore shows containers in which the connection and conduction means are associated with two circuits:

an earth circuit which comprises the conduction means of the container 1*a* (strips 30), the conduction means of the container 1*b* (earth wire 19) and the connecting means (ring 12 and U-shaped elements 34*a* and 34*b*).

a feed circuit which comprises the conduction means of the container 1*a* (first connecting wire, metal-coated surface 35, second connecting wire 18), the conduction means of the container 1*b* (connecting wire 20), and the connecting means (contact surfaces 21*a* and 21*b* of the caps).

As has already been explained, it would be possible in this case to replace the earth wire 19 with conductive strips on the internal surface of the cap 11*b*.

It would also be possible to deposit a metal film across the entire internal surface of the container.

Finally, the container according to the invention may also be a container of the modular type intended to be rigidly affixed to two other containers, so that an artillery charge of a given power is produced. Modular containers are already known, as disclosed in WO8601584, for example. As part of this application, the invention will ensure that there is instantaneous ignition of the whole charge irrespective of the number of containers that are stacked on top of one another.

All the embodiments disclosed above relate to containers filled with a propulsive charge and the electrical conduction and connecting means are in each case intended to provide the electrical connection between two igniters. The conduction and connecting means previously disclosed may also be used to link the fuse of a projectile (for example, explosive) with the shell base of the bottom container. The shell base shall then be modified in order to hold several contact pins via which the signals intended for the projectile will be sent.

These pins shall be connected to the conduction and connecting means disclosed above (strips, metal coating, caps, U-shaped elements, etc) by means of flexible wires and conductive adhesive strips.

The projectile-bearing container (whether or not it contains a propulsive charge) shall comprise the conduction and connecting means disclosed above (caps, U-shaped elements, strips, metal coating, etc) connected by means of flexible wires to the body of the projectile, for example to the base or tail section.

We claim:

1. A container assembly for propelling a projectile from a weapon, comprising:

first and second containers which are separable from each other, said first container comprising a casing and a contact pin for receiving an electrical signal from a weapon, said casing of said first container having first and second ends, said first end being closed by a top cover, said second container comprising a casing having said projectile at least partially housed therein, said casing of said second container having first and second ends, said first end being closed by a bottom cover;

electrical connection means for electrically connecting said contact pin to said projectile such that an electrical signal may be transmitted to said projectile from said weapon when said first and second containers are assembled together with said top and bottom covers in contact with each other, said electrical connection means comprising: a first conductor extending through said first container, a first end of said first conductor being connected to said contact pin; a second conductor extending through said second container, a first end of said second conductor being connected to said projectile; and connector means for electrically connecting said first and second conductors to each other; and a flame-transmitting device extending axially along substantially the entire length of said first container, said first conductor being secured to said flame-transmitting device.

2. The container assembly of claim 1, wherein said second conductor is attached to the casing of said second container.

3. The container assembly of claim 1, wherein said first conductor comprises a metal coating.

4. The container assembly of claim 1, wherein said first conductor comprises at least one metal strip.

5. The container assembly of claim 1, wherein said connector means comprises a first conductive surface disposed on said top cover of said first container, and a second conductive surface disposed on said bottom cover of said second container.

6. The container assembly of claim 5, wherein at least an outer peripheral surface of said top cover of said first container is electrically conductive.

7. The container assembly of claim 1, wherein said connector means comprises a movable ring for mechanically and electrically connecting said first and second containers to each other.

8. The container assembly of claim 7, wherein said casings of said first and second containers are cylindrical, a portion of said casing of said first container which is adjacent said top cover has a reduced-diameter, and a portion of said casing of said second container adjacent said bottom cover has a reduced-diameter, said movable ring being movable so as to cover partially each of said reduced-diameter portions.

9. The container assembly of claim 8, wherein each of said first and second containers further comprises a connecting element for electrically connecting said movable ring to respective first and second conductors.

10. The container assembly of claim 9, wherein each of said connecting elements is U-shaped and is positioned between its respective top or bottom cover and reduced-diameter portion.

11. The container assembly of claim 1, wherein said first container contains a propellant charge.

12. The container assembly of claim 11, wherein said first container further comprises an ignitor connected to said contact pin to ignite said propellant charge.

13. A container assembly for propelling a projectile from a weapon, comprising:

first and second containers which are separable from each other, said first container comprising a casing and a contact pin for receiving an electrical signal from a weapon, said casing of said first container having first and second ends, said first end being closed by a top cover, said second container comprising a casing having said projectile at least partially housed therein, said casing of said second container having first and second ends, said first end being closed by a bottom cover; and electrical connection means for electrically connecting said contact pin to said projectile such that an electrical signal may be transmitted to said projectile from said weapon when said first and second containers are assembled together with said top and bottom covers in contact with each other, said electrical connection means comprising: a first conductor extending through said first container, a first end of said first conductor being connected to said contact pin; a second conductor extending through said second container, a first end of said second conductor being connected to said projectile; and connector means for electrically connecting said first and second conductors to each other, wherein said first conductor comprises a metallized inner wall of the casing of the first container.

14. The container assembly of claim 13, wherein said second conductor is attached to the casing of said second container.

15. The container assembly of claim 13, wherein said first container further comprises a flame-transmitting device extending axially along substantially the entire length of said first container.

16. The container assembly of claim 13, wherein said connector means comprises a first conductive surface disposed on said top cover of said first container, and a second conductive surface disposed on said bottom cover of said second container.

17. The container assembly of claim 16, wherein at least an outer peripheral surface of said top cover of said first container is electrically conductive.

18. The container assembly of claim 13, wherein said connector means comprises a movable ring for mechanically and electrically connecting said first and second containers to each other.

19. The container assembly of claim 18, wherein said casings of said first and second containers are cylindrical, a portion of said casing of said first container which is adjacent said top cover has a reduced-diameter, and a portion of said casing of said second container adjacent said bottom cover has a reduced-diameter, said movable ring being movable so as to cover partially each of said reduced-diameter portions.

20. The container assembly of claim 19, wherein each of said first and second containers further comprises a connecting element for electrically connecting said movable ring to respective first and second conductors.

21. The container assembly of claim 20, wherein each of said connecting elements is U-shaped and is positioned between its respective top or bottom cover and reduced-diameter portion.

22. The container assembly of claim 13, wherein said first container contains a propellant charge.

23. The container assembly of claim 22, wherein said first container further comprises an ignitor connected to said contact pin to ignite said propellant charge.

24. A container assembly for propelling a projectile from a weapon, comprising:

first and second containers which are separable from each other, said first container comprising a casing and a contact pin for receiving an electrical signal from a weapon, said casing of said first container having first and second ends, said first end being closed by a top cover, said second container comprising a casing having said projectile at least partially housed therein, said casing of said second container having first and second ends, said first end being closed by a bottom cover; and electrical connection means for electrically connecting said contact pin to said projectile such that an electrical signal may be transmitted to said projectile from said weapon when said first and second containers are assembled together with said top and bottom covers in contact with each other, said electrical connection means comprising: a first conductor extending through said first container, a first end of said first conductor being connected to said contact pin; a second conductor extending through said second container, a first end of said second conductor being connected to said projectile; and connector means for electrically connecting said first and second conductors to each other, said connector means comprising a first conductive surface disposed on said top cover of said first container, and a second conductive surface disposed on said bottom cover of said second container.

25. The container assembly of claim 24, wherein said first and second conductors are attached to the casings of said first and second containers, respectively.

26. The container assembly of claim 24, wherein said first container further comprises a flame-transmitting device extending axially along substantially the entire length of said first container, said first conductor being secured to said flame-transmitting device.

27. The container assembly of claim 26, wherein said first conductor comprises a metal coating.

28. The container assembly of claim 24, wherein said first conductor comprises at least one metal strip.

29. The container assembly of claim 24, wherein said first conductor comprises a metallized inner wall of the casing of the first container.

30. The container assembly of claim 24, wherein at least an outer peripheral surface of said top cover of said first container is electrically conductive.

31. The container assembly of claim 24, further comprising a movable ring for mechanically connecting said first and second containers to each other.

32. The container assembly of claim 31, wherein said casings of said first and second containers are cylindrical, a portion of said casing of said first container which is adjacent said top cover has a reduced-diameter, and a portion of said casing of said second container adjacent said bottom cover has a reduced-diameter, said movable ring being movable so as to cover partially each of said reduced-diameter portions.

33. The container assembly of claim 24, wherein said first container contains a propellant charge.

34. The container assembly of claim 33, wherein said first container further comprises an ignitor connected to said contact pin to ignite said propellant charge.

35. A container assembly for propelling a projectile from a weapon, comprising:

first and second containers which are separable from each other, said first container comprising a casing and a contact pin for receiving an electrical signal from a weapon, said casing of said first container having first and second ends, said first end being closed by a top cover, said second container comprising a casing having said projectile at least partially housed therein, said casing of said second container having first and second ends, said first end being closed by a bottom cover; and electrical connection means for electrically connecting said contact pin to said projectile such that an electrical signal may be transmitted to said projectile from said weapon when said first and second containers are assembled together with said top and bottom covers in contact with each other, said electrical connection means comprising: a first conductor extending through said first container, a first end of said first conductor being connected to said contact pin; a second conductor extending through said second container, a first end of said second conductor being connected to said projectile; and connector means for electrically connecting said first and second conductors to each other, said connector means comprising a movable ring for mechanically and electrically connecting said first and second containers to each other.

36. The container assembly of claim 35, wherein said first and second conductors are attached to the casings of said first and second containers, respectively.

37. The container assembly of claim 35, wherein said first container further comprises a flame-transmitting device extending axially along substantially the entire length of said first container, said first conductor being secured to said flame-transmitting device.

38. The container assembly of claim 37, wherein said first conductor comprises a metal coating.

39. The container assembly of claim 35, wherein said first conductor comprises at least one metal strip.

40. The container assembly of claim 35, wherein said first conductor comprises a metallized inner wall of the casing of the first container.

41. The container assembly of claim 35, further comprising a first conductive surface disposed on said top cover of said first container, and a second conductive surface disposed on said bottom cover of said second container.

42. The container assembly of claim 41, wherein at least an outer peripheral surface of said top cover of said first container is electrically conductive.

43. The container assembly of claim 35, wherein said casings of said first and second containers are cylindrical, a portion of said casing of said first container which is adjacent said top cover has a reduced-diameter, and a portion of said casing of said second container adjacent said bottom cover has a reduced-diameter, said movable ring being movable so as to cover partially each of said reduced-diameter portions.

44. The container assembly of claim 43, wherein each of said first and second containers further comprises a connecting element for electrically connecting said movable ring to respective first and second conductors.

45. The container assembly of claim 44, wherein each of said connecting elements is U-shaped and is positioned between its respective top or bottom cover and reduced-diameter portion.

46. The container assembly of claim 35, wherein said first container contains a propellant charge.

47. The container assembly of claim 46, wherein said first container further comprises an ignitor connected to said contact pin to ignite said propellant charge.

* * * * *